US005628526A

United States Patent [19]

Zotter et al.

[11] Patent Number: 5,628,526

[45] Date of Patent: May 13, 1997

[54] HEEL PART FOR A SKI BINDING

[75] Inventors: Johann Zotter, Vienna; Friedrich Leichtfried, Traiskirchen, both of Austria

[73] Assignee: HTM Sport- und Freizeitgeraete Aktiengesellschaft, Schwechat, Austria

[21] Appl. No.: 256,225

[22] PCT Filed: Oct. 20, 1993

[86] PCT No.: PCT/EP93/02904

§ 371 Date: Sep. 2, 1994

§ 102(e) Date: Sep. 2, 1994

[87] PCT Pub. No.: WO94/09870

PCT Pub. Date: May 11, 1994

[30] Foreign Application Priority Data

Oct. 23, 1992 [AT] Austria ..... 2107/92

[51] Int. Cl.[6] ..... A63C 9/084

[52] U.S. Cl. ..... 280/633

[58] Field of Search ..... 280/607, 617, 280/633, 634, 636; 441/70

[56] References Cited

U.S. PATENT DOCUMENTS

| | | | |
|---|---|---|---|
| 2,382,149 | 8/1945 | Hartman | 441/70 |
| 3,703,013 | 11/1972 | Leach | 441/70 |
| 4,157,193 | 6/1979 | Beyl | 280/633 |
| 4,522,424 | 6/1985 | Luitz et al. | 280/633 |
| 5,096,218 | 3/1992 | Bardin | 280/633 |
| 5,188,388 | 2/1993 | Rohrmoser | 280/633 |
| 5,209,516 | 5/1993 | Arduin et al. | 280/633 |

FOREIGN PATENT DOCUMENTS

| | | |
|---|---|---|
| 394513 | 4/1993 | European Pat. Off. . |
| 2451756 | 10/1980 | France . |

*Primary Examiner*—Brian L. Johnson

*Attorney, Agent, or Firm*—Flynn, Thiel, Boutell & Tanis, P.C.

[57] ABSTRACT

A heel part for use on a ski binding, the ski binding being movable in a longitudinal direction relative to a ski-fixed guide (2) and can be secured in different positions by a locking piece (5) supported in a housing (3) and movably urged in a longitudinal direction against a housing-fixed stop (14) by a spring (13) and is limitedly pivotal, with the locking piece (5) being pivoted with a lock (10) in direction of a counterclock (15) of the ski-fixed guide (2) through a spring (13) engaging the locking piece above the stop (14), and with a two-arm opening lever (16) to release the locking, with one lever arm of the opening lever (16) being designed essentially U-shaped, viewed from the rear, the connecting bight bar (18) between its two legs engaging from below the rear end of the locking piece (5) and the two legs of the opening lever (16) extending from the connecting bight bar (18) upwardly to a bearing point (17) on the housing, and at least one leg of the opening lever (16) forms extending forwardly bent, on the side of the housing (3), a leg section, which carries an outwardly projecting handle set (23*a*) on its free end section.

5 Claims, 3 Drawing Sheets

HEEL PART FOR A SKI BINDING

FIELD OF THE INVENTION

The invention relates to a heel part for use on a ski binding, the ski binding being movable in a longitudinal direction relative to a ski-fixed guide and can be fastened in different positions with a locking piece supported in a housing and movably urged in a longitudinal direction against a housing-fixed stop by means of a spring and limitedly pivotal about the stop, the locking piece having engaging means engaging counterlocking means on the ski-fixed guide, with the locking piece with its engaging means being pivoted in direction of the counterlocking means by the spring engaging the locking piece above the stop, and with a two-arm opening lever supported in the housing, one lever arm of which has handles and the other lever arm engages the rear end of the locking piece, such that upon a pivoting of the opening lever, the locking piece is pivoted away from the guide and the locking piece is released.

DESCRIPTION OF THE PRIOR ART

In ski bindings of this type, of which designs, which are part of the state of the art, will be discussed in detail later on, the heel part, which is also called the automatic heel, is locked corresponding with the size of the shoe in a specific position along the guide. The use of a manually easily operable opening lever is mainly desired when a specific ski is more often supposed to be used with shoes having various sizes, which is mainly of great importance for the ski-rental business.

In a binding of the above-mentioned type known from EP-A-0 394 513 (FIGS. 19 and 21) the locking means are laterally opening notches provided on the locking piece, which notches can receive therein corresponding laterally projecting rows of teeth of the ski-fixed guide. The two-arm opening lever supported in the housing has two handles on the left and right of the housing, which handles are provided at the ends of a shaft and represent the first lever arm, and two further pins are provided farther in on the axis. The locking part is bent upwardly at a right angle at its rear end and then again at a right angle forwardly forming an extension, with the pins being able to engage the extension. The locking piece is in this known design bulky at its end because of it being bent twice and requires a relatively large space within the housing, which has a negative effect on its building height. Furthermore, arranging the pins on the shaft is disadvantageous in view of the load distribution and creates an area at risk of breakage. Also locking by means of laterally projecting rows of teeth is disadvantageous since a large angle of traverse of the locking piece is needed in order to enable a complete engagement of the locking teeth. Finally the handles must be pressed or pulled forwardly in order to cause a pivoting of the opening lever, which in practice eliminates or makes more difficult an operation with only one hand.

A similar construction is known from FR-A-2 451 756, in which the blocking piece has downwardly projecting locking noses received in locking holes of the guide. The locking piece has an end section bent upwardly at 90° at its rear end, into which end section is recessed a window. A pin projecting from a U-shaped bar supported on the rear end of the housing is received in the window. The U-shaped bar extends approximately vertically and can be lifted up by means of a special tool which is inserted between the housing wall and the horizontally extending connecting bar of the U-shaped bar and is then rotated, with the pin lifting up the locking piece at the rear end so that it is disengaged from the guide. Using a special tool is viewed as being disadvantageous since such tools can be misplaced and are lost and in most cases not at hand when they are needed.

Furthermore, a ski binding has become known from EP-A1-498 153, which in one embodiment (FIGS. 3 to 9) has a two-arm lever which is a bent wire bar having several bending planes. The lever is supported in the housing and acts with lateral arm parts on a special connecting piece which extends downwardly and engages the locking piece. Using the additional connection piece makes the assembly more difficult and increases the cost of the design. To adjust the heel part, the end piece of the wire bar, which end piece lies on the rear side of the housing, must be pulled up in order to release the locking. It is therefore difficult for the mechanic to release the locking with one hand alone and to move the heel part along the ski-fixed guide.

The opening lever in a different embodiment (FIGS. 10to 12) is not designed with two arms but with one arm, with it engaging, with center sections, the locking piece. An end bar of this one-arm lever rests on the rear side of the housing and must be pulled up to release the locking. This design results in such a lever-transmission ratio that a manual release of the locking is here also hardly possible.

SUMMARY OF THE INVENTION

A purpose of the invention is to create a ski binding, which enables a simple and quick adjustment of the heel part relative to the ski-fixed guide, with the unlocking of the locking piece being able to be carried out using little force, without a tool, and also with only one hand. However, the design is to be as compact as possible and the material and manufacture expense is to be low.

This purpose is attained according to the invention starting out from a ski binding of the above-mentioned type such that the lever arm of the opening lever, which lever arm engages the locking piece, is designed essentially U-shaped as viewed from the rear, with the connecting bar of its two legs engaging from below the rear end of the locking piece and the two legs of the opening lever extending from the connecting bar upwardly to their bearing point on the housing, and that at least one leg of the opening lever forms a forwardly extending bent section on the side of the housing, which leg section carries at its free end section an outwardly projecting handle set.

Particular advantages of the invention are, aside from the simple and inexpensive design, the possibility to release the locking piece and to move the heel part to the new desired position with one hand, the opening lever being thereby able to be pulled up, for example, with the thumb or middle finger and the palm of the hand engaging the top of the heel part. It is also possible in this manner to create a favorable total transmission ratio from the handle set to the locking piece.

BRIEF DESCRIPTION OF THE DRAWINGS

The invention together with other advantages is disclosed hereinafter in connection with exemplary embodiments and the aid of the drawings, in which.

DESCRIPTION OF THE PREFERRED EMBODIMENTS

Figure 1:
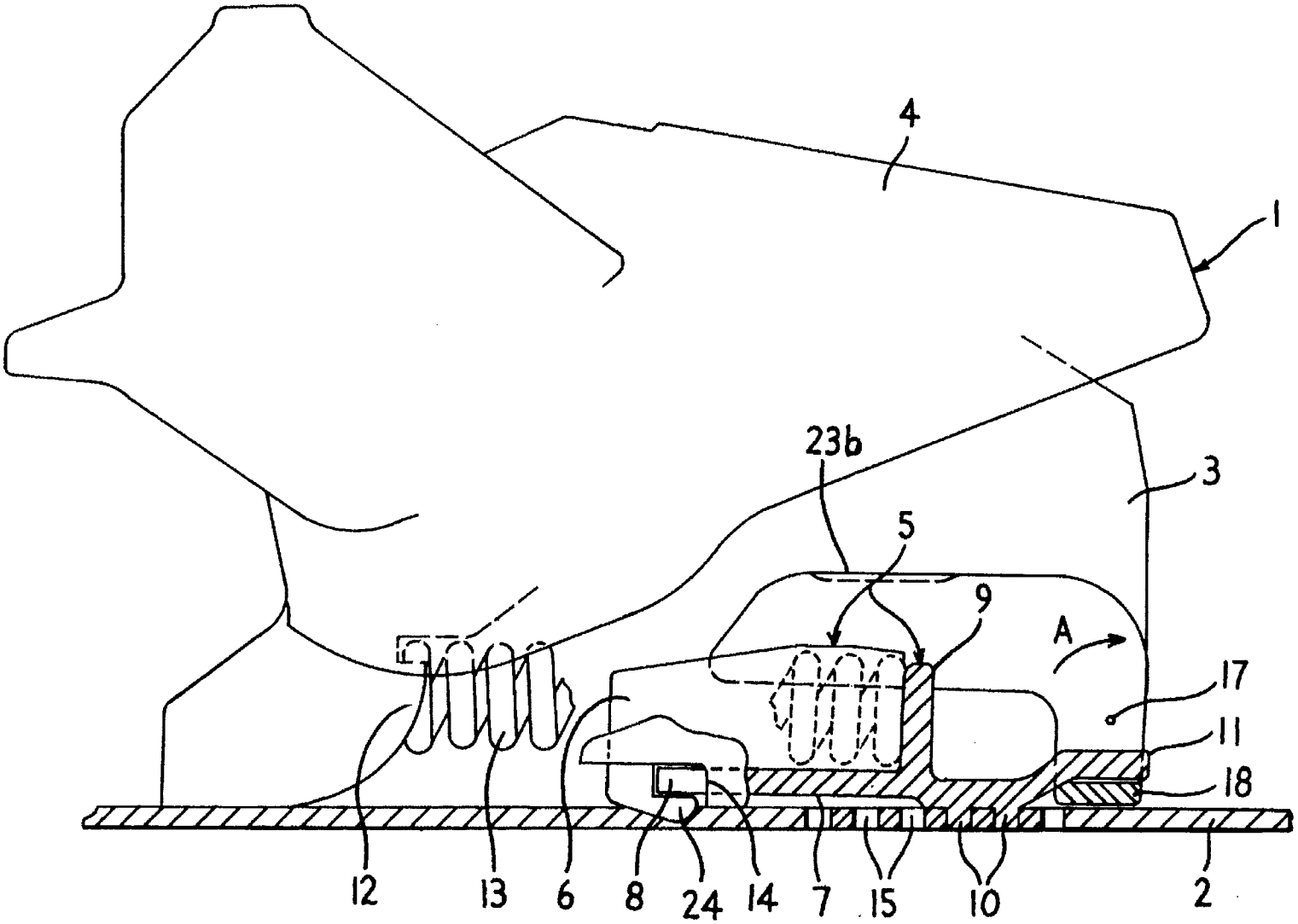
FIG. 1 is a schematic side view of the ski binding of the invention, partially in cross section, with a locking piece engaging a ski-fixed guide.

The heel part 1 of a ski binding is, according to FIG. 1, guided along a ski-fixed guide 2 which is, for example, secured by screws to the ski. Such guides are part of the state of the art and are known, for example, from FIG. 5 of the already mentioned FR-A-2 451 756.

The heel part 1 consists of a housing 3 and a heel jaw 4 which is pivotal relative to the housing and can be locked and released under specific load conditions.

The heel part 1 is able to be releasably locked—in dependent relation to the size of the shoe—in various positions relative to the guide 2. A locking piece 5 is provided for this purpose within the housing 3, which locking piece consists of a bearing and spring-guiding member 6 and of a locking plate 7. The latter can be seen in greater detail in FIG. 3.

The locking plate 7, which is manufactured, for example, of metal, by stamping, has two laterally projecting bearing bars 8 at its front end. A spring-supporting bar 9 projects approximately at a right angle in an upward direction from the locking plate 7.

Small locking noses 10, in the present case four, project farther in the back from the underside of the locking plate 7, and the locking plate 7 has at its rear end an upwardly extending bent part 11.

The locking plate 7 is form-lockingly inserted into the bearing and spring-guiding member consisting of plastic. The entire locking piece 5 is inserted into the housing 3 in the manner shown in FIGS. 1 and 2. A pressure spring 13 engages between the spring-supporting bar 9 and a housing-fixed spring support 12, which pressure spring presses the locking piece 5 rearwardly such that the two bearing bars 8 are each supported rearwardly against a housing-fixed stop 14 so as to prevent further movement in the rearward direction. Since the pressure spring 13 engages above the stops 14, the locking piece 5 is also loaded—in the drawing in clockwise direction—with a torque. The locking noses 10 are received in locking holes 15 which are constructed in two parallel rows in the ski-fixed guide 2.

Besides the purpose of holding the locking piece 5 in its locked position, the spring 13 also has the task of pressing the heel part 1 against a shoe inserted into the binding. The heel part 1 thus slides farther to the rear during a simultaneous further compression of the pressure spring 13 upon insertion of a shoe.

In order to adjust the binding to a shoe of a different size, the heel part 1 is usually adjusted relative to the ski-fixed guide 2. The locking piece 5 must for this purpose be disengaged and must engage again in a new position.

Figure 3A:
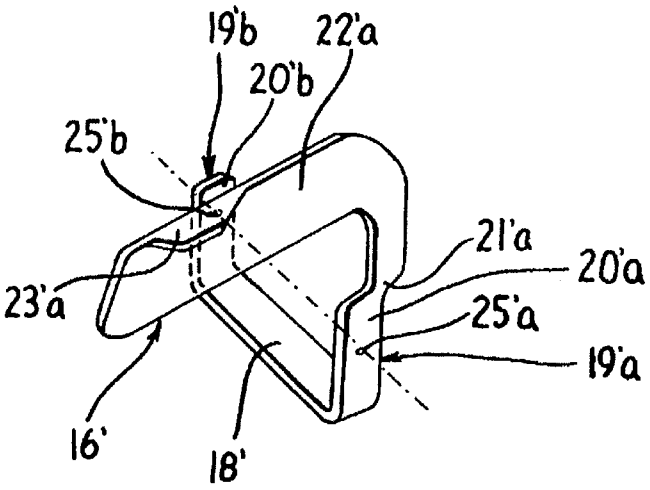
FIG. 3A shows a modification of the opening lever.
Figure 3:
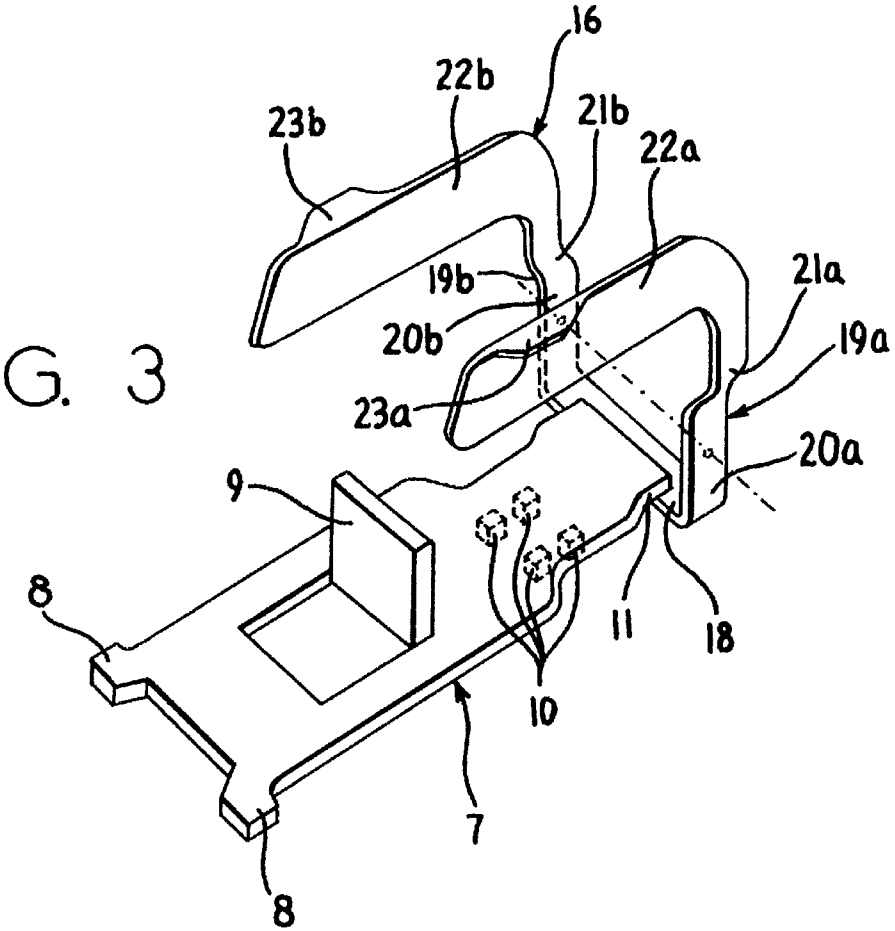
FIG. 3 is a perspective illustration of the locking piece and the opening lever engaging same.

An opening lever 16 is provided for this purpose in the present case, which opening lever can best be seen in FIG. 3. This lever 16, viewed kinematically, has two arms and is hinged to a housing-fixed bearing point 17, for example, by means of rivets. The opening lever 16 is, viewed from the rear (or from the front), designed essentially U-shaped and the connecting bight bar 18 between its two legs 19*a, b* lies below the bent part 11 of the locking plate 7 or rather engages same. First leg sections 20*a, b* extend from the connecting bight bar 18 upwardly to the mentioned bearing point 17 on the housing 3, they each have one outwardly bent part 21*a, b* and transfer, then bend forwardly into second leg sections 22*a, b*, which extend essentially perpendicular to the first leg sections 20*a, b*. Each one of the forwardly extending second leg sections 22*a, b* carries at its free end section an outwardly projecting handle set 23*a, b*.

In order to temporarily release the locking of the locking piece 5 or rather of the locking plate 7 with the guide 2, the heel part 1 is embraced from above, for example, the handle sets 23*a, b* of the legs 19 are gripped with the thumb and middle finger and their second sections 22*a, b* are pulled upwardly, resulting in a pivoting of the lever 16 in the direction of the arrow A. The connecting bight bar 18 engages thereby with its front edge the bent part 11 or rather the transition section of the plate 7 to the bent part 11 and lifts up the rear end of the locking plate 7 causing the locking noses 10 to be lifted out of the locking holes 15. The locking plate 7 pivots hereby—counterclockwise in the drawing—about the housing-fixed stop 14 in the direction of the arrow B, such that sliding noses 24 of the guiding member 6 roll along the ski-fixed guide 2 in this exemplary embodiment. These sliding noses 24 are constructed on the lower section of the bearing and spring-guiding member 6 and are supported on the ski-fixed guide 2.

Figure 2:
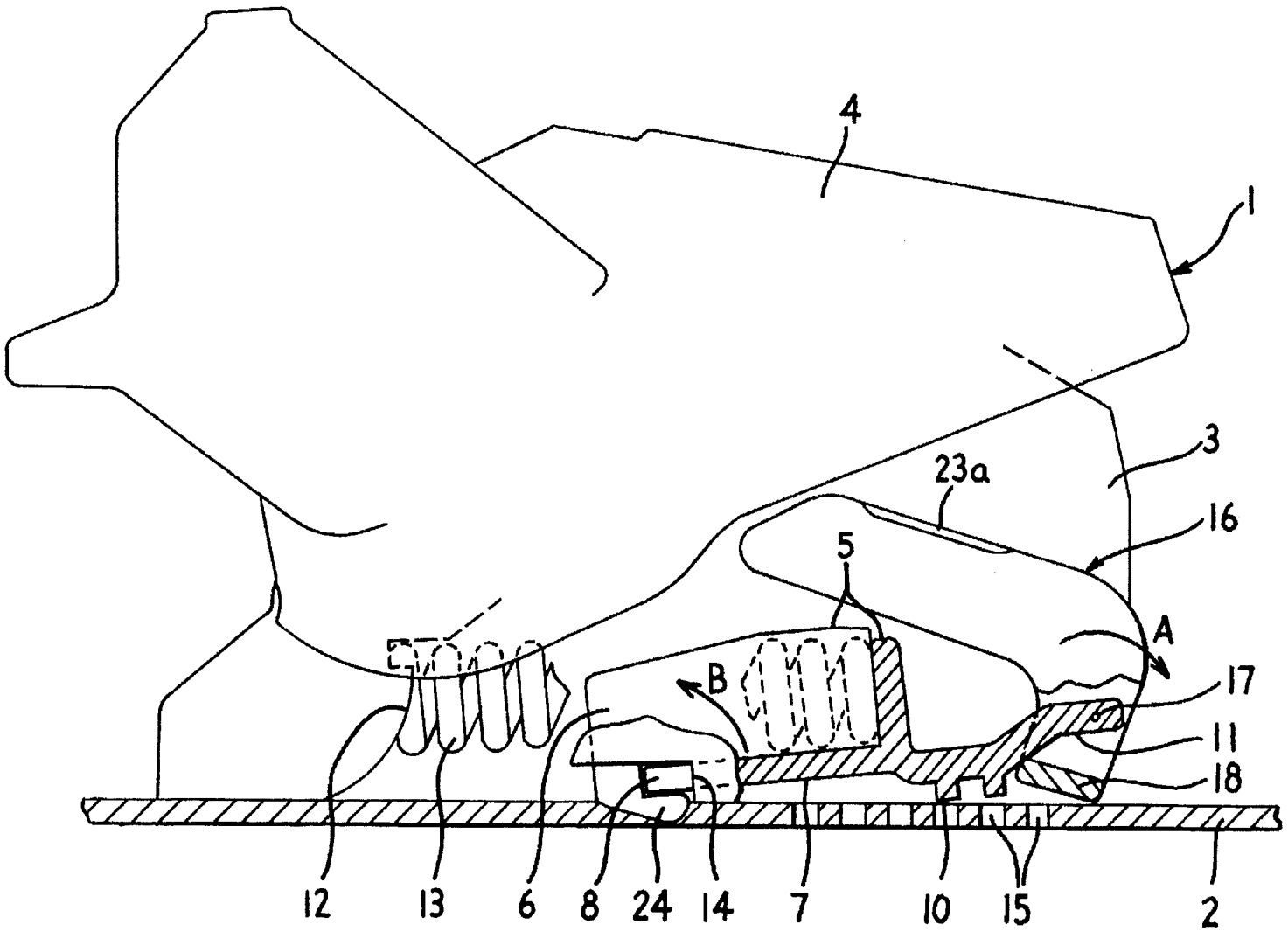
FIG. 2 shows the binding in the same view, however, with the locking piece being disengaged.

The heel part 1 can in the disengaged position shown in FIG. 2 be moved forwardly or rearwardly into the desired new position. After letting go of the opening lever 16 and, if necessary, a slight movement of the heel part 1, the locking noses 10 are received in the desired new locking holes 15.

FIG. 3*a* shows that the opening lever 16' can have also only on one side a bent part 21'*a* and a front leg section 22'*a* with a handle set 23'*a*, with only the first leg section 19'*b* being provided on the other side. FIG. 3*a* shows bores 25'*a, b*, which are constructed in the first leg sections 19'*a, b*. The lever 16' can be rotatably supported on the housing 3 by means of not illustrated rivets, etc., which extend through these bores 25'*a, b*.

The above description shows that the invention, aside from the simple design which also guarantees a safe operation, enables a quick adjustment of the heel piece and with only one hand, which is particularly desirous in the ski-rental business.

We claim:

1. In a heel part for use on a ski binding, the ski binding including a housing being movable in a longitudinal direction relative to a ski-fixed guide and selectively secured in different positions, said housing including a locking piece being supported in said housing and movably urged in a longitudinal direction against a housing-fixed stop by a spring means and is limitedly pivotal about said stop, said locking piece having locking means engageable with a counterlocking means on said ski-fixed guide, said locking piece and said locking means being pivoted in a direction of said counterlocking means by said spring means engaging said locking piece above said stop, and a two-arm opening lever supported on said housing, one lever arm of said opening lever having handles and the other lever arm of said opening lever engaging a rear end of said locking piece, said locking piece being pivoted away from said guide during a pivoting of said opening lever to release said locking piece, the improvement wherein said lever arm of said opening lever is generally U-shaped as viewed from the rear and has a connecting bight bar extending between a first and a second leg thereof, said bight bar engaging the rear end of said locking piece from below, said first and second legs of said opening lever extending from said connecting bight bar upwardly to a bearing point on said housing, and wherein at least one of said first and second legs of said opening lever forms a forwardly extending bent leg section on a side of said housing, said leg section carrying on a free end section thereof an outwardly projecting handle set.

2. The ski binding according to claim 1, wherein the other of said first and second legs of said opening lever further comprises a forwardly extending leg section on the other side of said housing extending parallel to said forwardly extending leg section of said at least one of said first and second legs of said opening lever, and wherein said other of said first and second legs has a laterally outwardly projecting handle set.

3. The ski binding according to claim 1, wherein said at least one of said first and second legs of said opening lever further comprises an outwardly directed bent part at a transition from a vertical leg section to said forwardly extending bent leg section.

4. The ski binding according to claim 1, wherein said locking piece comprises a bearing and spring-guiding member, and of a locking plate having a rear end with an upwardly extending bent part under which extends said connecting bight bar of said U-shaped opening lever.

5. The ski binding according to claim 4, wherein said locking piece has a plurality of sliding noses at a lower section of said bearing and spring-guiding member, and wherein said sliding noses are supported on said ski-fixed guide.

* * * * *